US006503008B2

(12) United States Patent
Zevin et al.

(10) Patent No.: US 6,503,008 B2
(45) Date of Patent: Jan. 7, 2003

(54) PRINT MEDIA ROLL HOLDER WITH MULTI-DIAMETER CORE ADAPTER

(75) Inventors: Thomas Michael Zevin, Canoga Park, CA (US); Joe Dufrain Rodriguez, Alta Loma, CA (US)

(73) Assignee: ZIH Corp., Wilmington, DE (US)

( * ) Notice: Subject to any disclaimer, the term of this patent is extended or adjusted under 35 U.S.C. 154(b) by 67 days.

(21) Appl. No.: 09/865,835

(22) Filed: May 25, 2001

(65) Prior Publication Data

US 2002/0175985 A1 Nov. 28, 2002

(51) Int. Cl.[7] ..... B41J 15/04
(52) U.S. Cl. ..... 400/613; 242/596.4; 242/596.7
(58) Field of Search ..... 400/613; 242/596.4, 242/596.7

(56) References Cited

U.S. PATENT DOCUMENTS 4,948,064 A * 8/1990 Richard ..... 242/129.5
5,813,343 A * 9/1998 Harb ..... 101/212
6,183,153 B1 * 2/2001 Kamoda et al. ..... 400/207

* cited by examiner

*Primary Examiner*—Stephen R. Funk
*Assistant Examiner*—Jill E Culler
(74) *Attorney, Agent, or Firm*—Fulbright & Jaworski LLP

(57) ABSTRACT

A print media roll holder includes a multi-diameter core adapter for mounting print media rolls of different core sizes. The roll holder comprises a ring-shaped frame having a base portion provided with a guide rack which is used for positional adjustment. The multi-diameter core adapter is pivotally mounted inside the ring-shaped frame on two opposing lateral pins inserted through the frame and through the core adapter for 180 degree rotation in a clockwise or counter-clockwise direction depending on the size of core being used. The guide rack is part of a rack and pinion gear system used to vary the spacing between the roll holders in a reciprocal linear fashion.

11 Claims, 7 Drawing Sheets

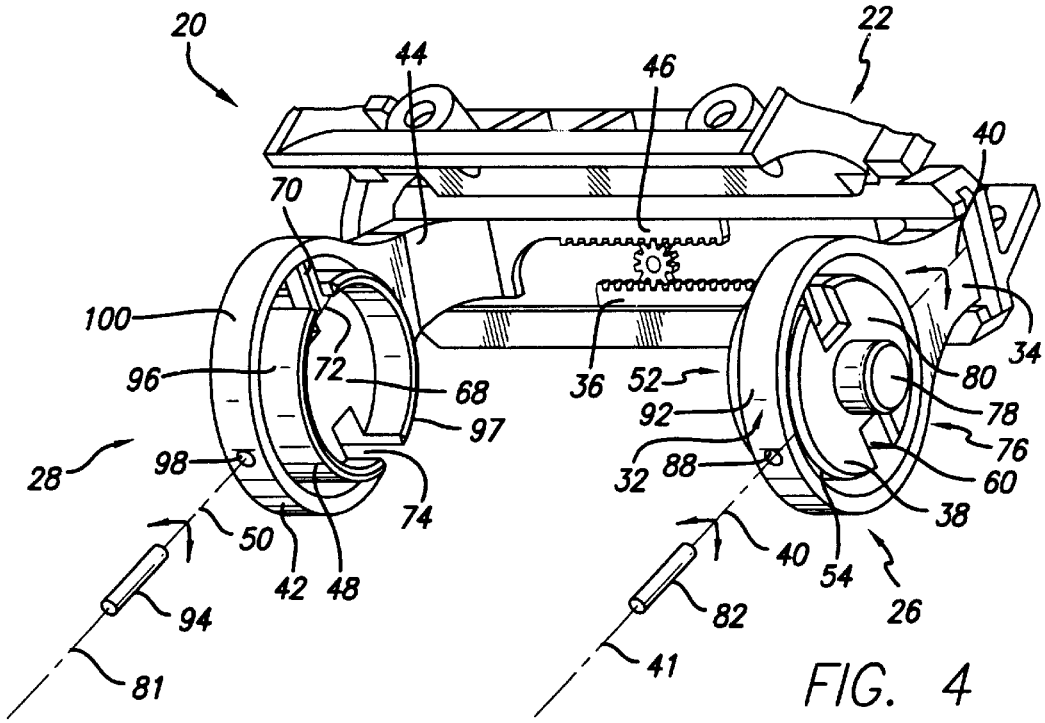
FIG. 4
FIG. 5
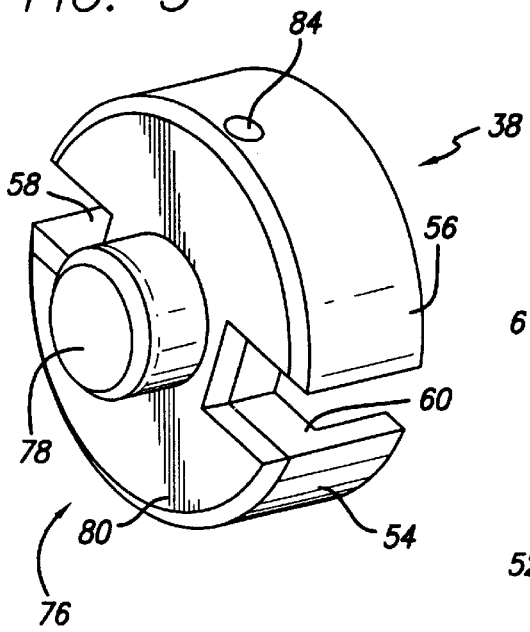
FIG. 6
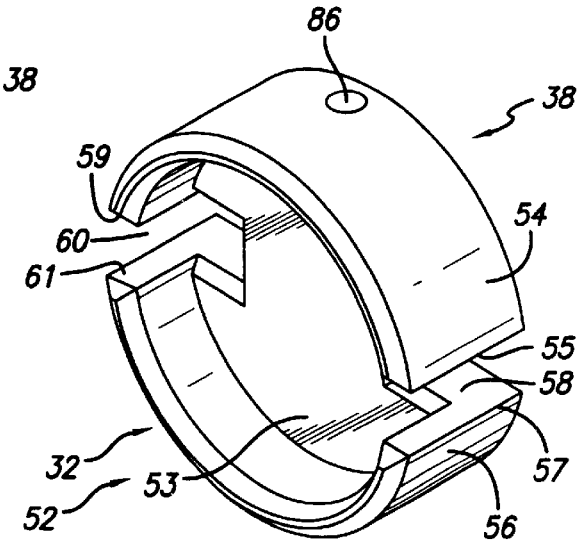

PRINT MEDIA ROLL HOLDER WITH MULTI-DIAMETER CORE ADAPTER

BACKGROUND OF THE INVENTION

1. Field of the Invention

The present invention relates generally to printing and more particularly to a print media roll holder with a multi-diameter core adapter for use in thermal label printers or the like.

2. Prior Art

Print media for thermal label printers is usually supplied on rolls with the media wound onto hollow cylindrical cardboard or plastic cores. The hollow core commonly comes in two sizes—a 1 inch inner diameter core and a ⅜ inch inner diameter core. The print media core is usually held by two opposing adjustable (media-width) print media roll holders mounted in the body of the label printer.

To accommodate different inner diameter core sizes, various compact removable core adapters for use with print media roll holders are known in the prior art. Removable core adapters suffer a number of disadvantages such as being easy to lose, drop, or damage. Other known solutions include various (usually integral) cylindrical core adapters with axially adjacent core diameters. These adapters, however, are usually bulky and demand considerable amount of space inside the printer at all times, i.e., regardless of whether the printer lid is open or closed, thereby limiting printer design options for the printer manufacturer.

Therefore, the need arises for an improved print media roll holder which preferably incorporates an integral multi-diameter core adapter that does not need any removable parts to operate, occupies a relatively small space inside the label printer compared to prior art devices, and is designed for easy inner diameter core size adjustment by the user.

SUMMARY OF THE INVENTION

The present invention is directed to a print media roll holder adapted for use with print media rolls of different core sizes, comprising a frame and a core adapter pivotally coupled within the frame for rotational movement about a central axis. The core adapter has a first side adapted for coupling to a print media core of a first inner core diameter and a second side adapted for coupling to a print media core of a second inner core diameter.

These and other aspects of the present invention will become apparent from a review of the accompanying drawings and the following detailed description of the preferred embodiments of the present invention.

BRIEF DESCRIPTION OF THE DRAWINGS

The invention is generally shown by way of example in the accompanying drawings in which:

FIG. 4 is a partial perspective view of a label printer base portion containing the print media roll holders of FIGS. 1–3 in accordance with the present invention;

FIG. 5 is a back perspective view of one of the multi-diameter core adapters of FIG. 4 in accordance with the present invention;

FIG. 6 is a front perspective view of one of the multi-diameter core adapters of FIG. 4 in accordance with the present invention;

DETAILED DESCRIPTION OF THE PREFERRED EMBODIMENTS

Figure 1:
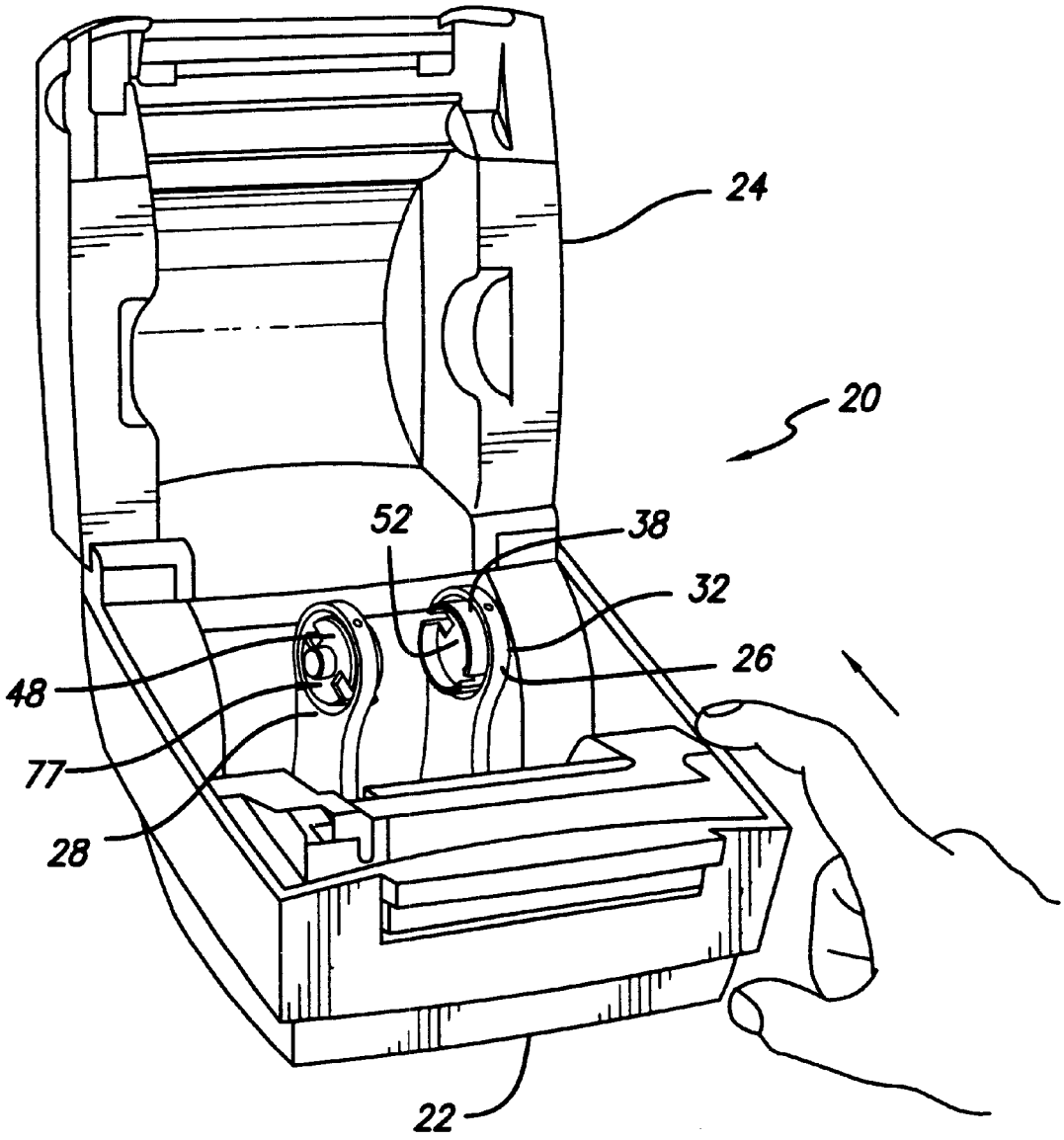
FIG. 1 is a perspective view of a thermal label printer having a pair of adjustable print media roll holders with integral multi-diameter core adapters in accordance with the present invention.

Hereinafter, some preferred embodiments of the present invention will be described in detail with reference to the related drawings of FIGS. 1–10. Additional embodiments, features and/or advantages of the invention will become apparent from the ensuing description or may be learned by the practice of the invention.

In the figures, the drawings are not to scale and reference numerals indicate the various features of the invention, like numerals referring to like features throughout both the drawings and the description.

The following description includes the best mode presently contemplated for carrying out the invention. This description is not to be taken in a limiting sense, but is made merely for the purpose of describing the general principles of the invention.

Figure 2:
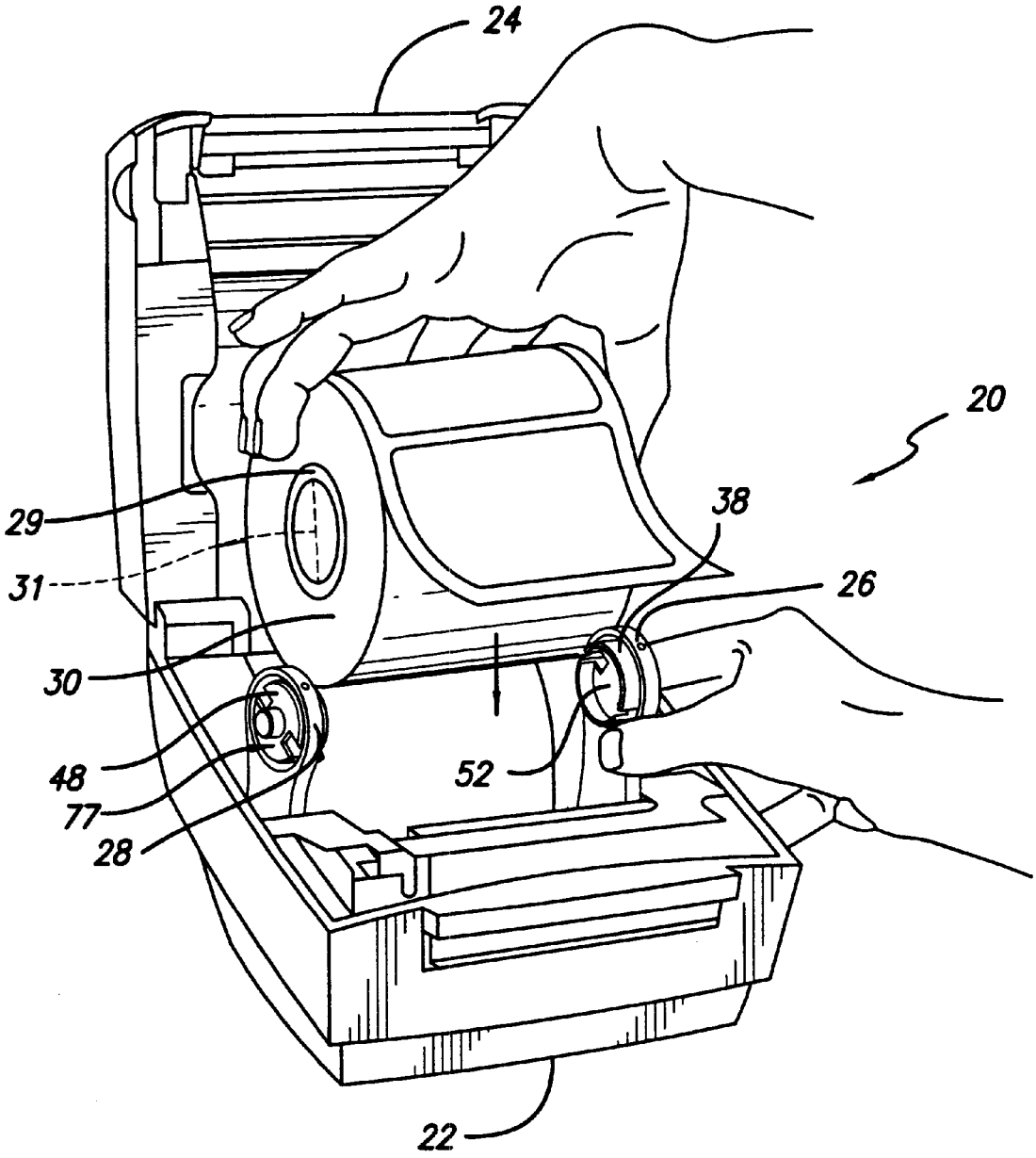
FIG. 2 shows the label printer of FIG. 1 with a print media roll being mounted on the print media roll holders in accordance with the present invention.
Figure 3:
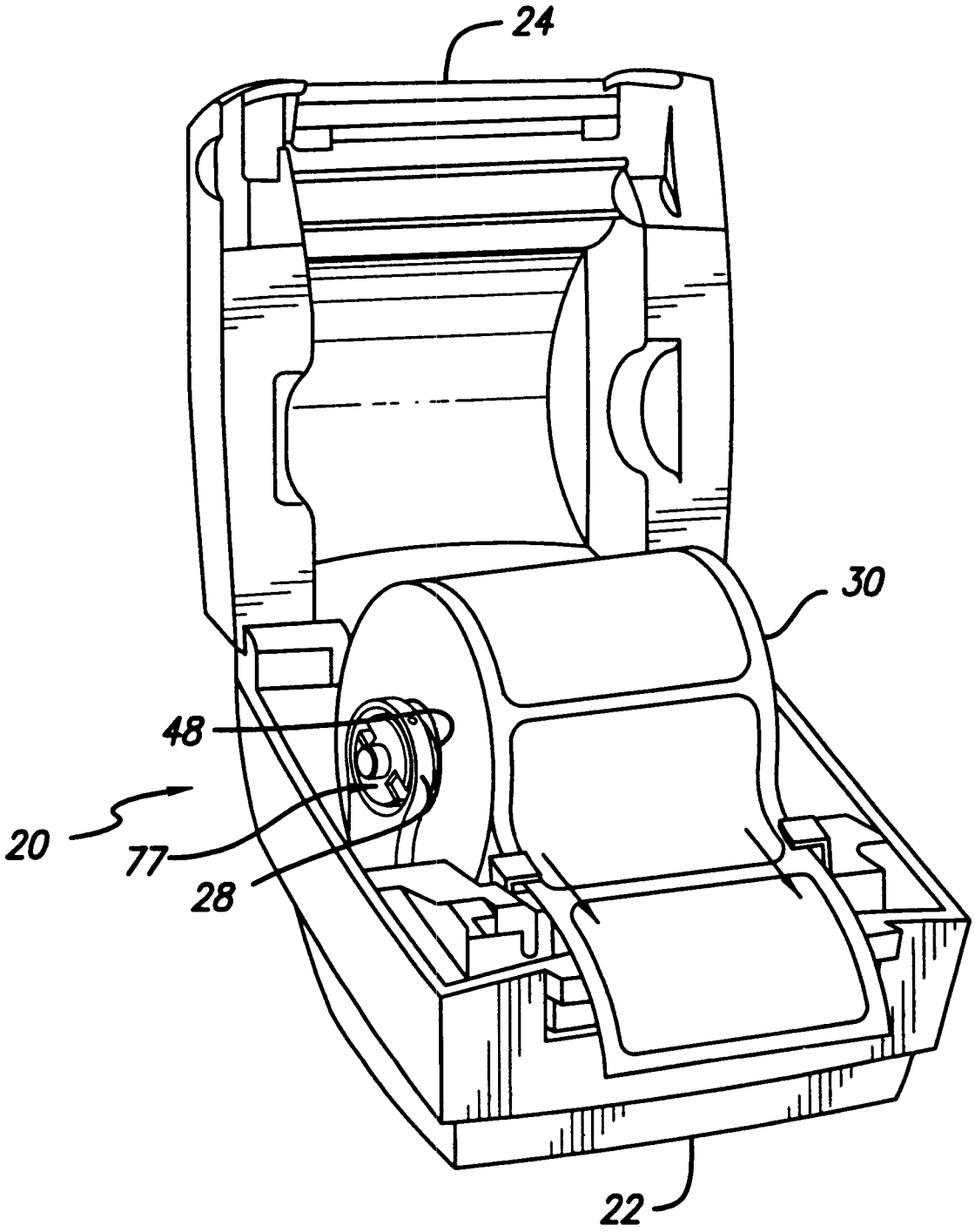
FIG. 3 shows the label printer of FIG. 2 with the mounted print media roll being supported by the print media roll holders in accordance with the present invention.

The present invention is directed to a thermal label printer, generally referred to by a reference numeral 20, which includes a printer base 22 hinged at one end to a printer lid 24 which is capable of limited angular rotation about its hinge (not shown) and is normally closed for printing and open for printer maintenance and/or media loading as illustrated in FIGS. 1–3. Printer base 22 preferably contains a pair of adjustable plastic print media roll holders 26, 28 which are adapted for mounting and supporting a print media roll 30 which has a plastic or cardboard tubular core 29 with an inner core diameter 31 (FIG. 2).

Figure 7:
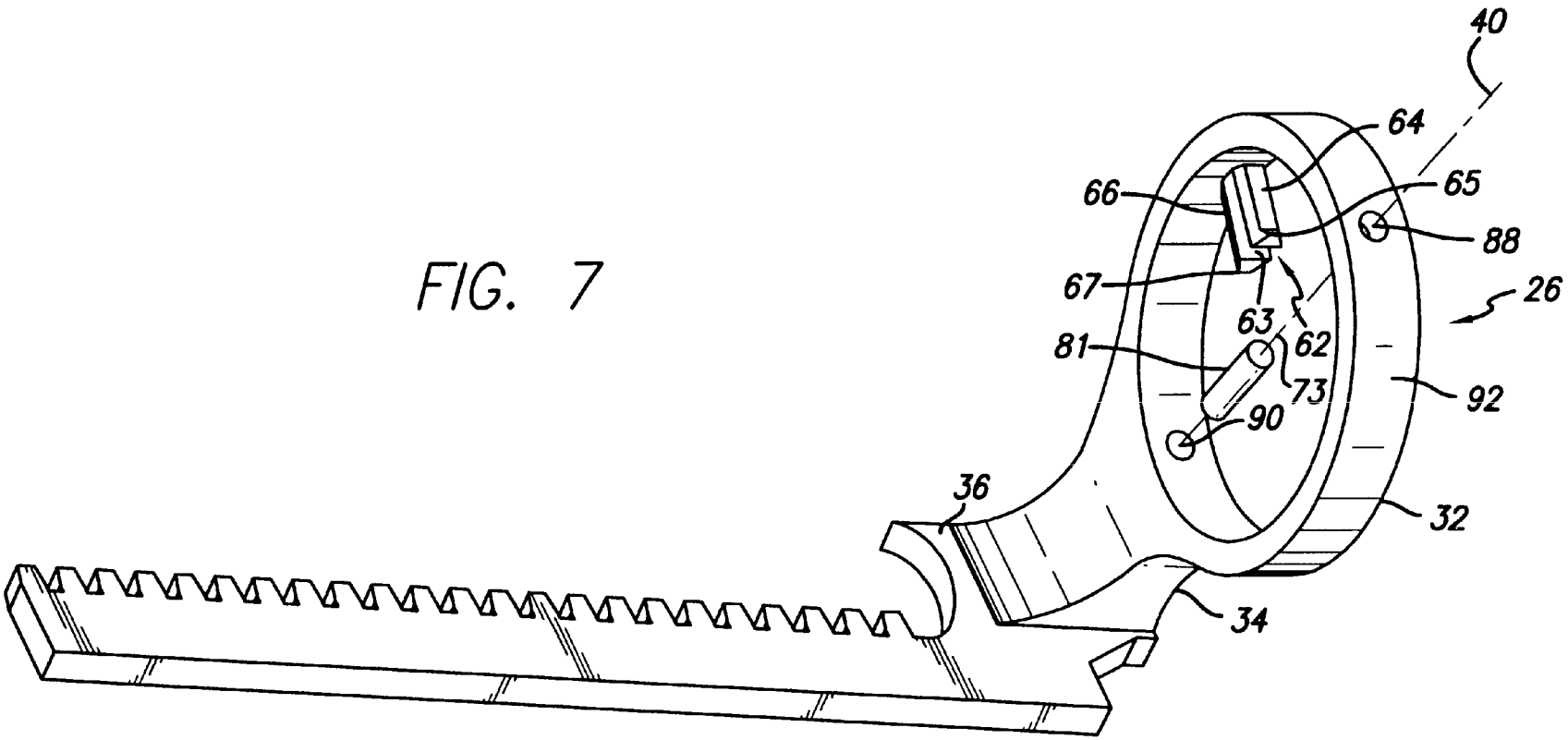
FIG. 7 is a side perspective view of a print media roll holder frame with a base including an integral guide rack in accordance with the present invention.

As generally depicted in FIG. 7, print media roll holder 26 comprises a substantially ring-shaped frame 32 which includes a tubular outer wall 92 and is supported at one end by an elongated base 34. Base 34 is preferably fitted at the bottom with an integral generally elongated guide rack 36 which is used for positional adjustment of print media roll holder 26 in printer 20. In a similar fashion and as shown generally in FIG. 4, print media roll holder 28 comprises a substantially ring-shaped frame 42 which includes a tubular outer wall 100 and is supported at one end by an elongated base 44. Base 44 is preferably fitted at the bottom with an integral generally elongated guide rack 46 which is used for positional adjustment of print media roll holder 28 in label printer 20. In general, guide racks 36, 46 need not be integral with bases 34, 44, respectively, i.e. other configurations may be used if there is no deviation from the intended purpose of the present invention.

In accordance with a preferred embodiment of the present invention, a plastic print media core adapter 48 of generally circular cross section is pivotally mounted at opposite sides along a diameter inside ring-shaped frame 42 of print media roll holder 28 as generally illustrated in FIG. 4. Similarly, an identically shaped plastic print media core adapter 38 also of generally circular cross section is pivotally mounted at opposite sides along a diameter inside ring-shaped frame 32 of print media roll holder 26 as shown in FIG. 4. Each core adapter is adapted to support a print media core of 1 inch inner core diameter on one side and a print media core of ⅜ inch inner core diameter on an opposite side, i.e., the core adapter of the present invention functions as a multi-diameter core adapter.

Specifically, as shown in FIGS. 1, 2, 6, one (i.e., the front) side of core adapter 38, i.e., side 52, is generally bowl-shaped and includes substantially semicircular outer walls 54, 56 rising from a circular base 53 and separated at each end by a snap receptacle, e.g., snap receptacles 58, 60 (FIG. 6) which are used to frictionally accommodate a plastic snap 62 molded on the inside of ring-shaped frame 32, as illustrated in FIG. 7, in an alternating fashion. In accordance with the best mode for practicing the present invention, semicircular outer walls 54, 56 are designed to fit snugly inside a 1 inch inner diameter print media core (FIG. 3) to a certain extent (e.g., about a third to a half of the outer surface area of walls 54, 56) to support a mounted (in between roll holders 26, 28) print media roll, such as print media roll 30 which is shown in FIG. 2 with a 1 inch inner core diameter 31.

As further illustrated in FIG. 7, plastic snap 62 comprises two integral generally parallel posts 64, 66 molded proximate to each other and defining a gap 63 in between on the inside of frame 32 with each post having a generally outwardly flared (away from each other) exterior end, such as flared exterior ends 65, 67, respectively, for frictional abutment against a corresponding side wall of each snap receptacle (58, 60), e.g., side walls 55, 57 of snap receptacle 58 or side walls 59, 61 of snap receptacle 60, so as to secure one or the other side of core adapter 38 within ring-shaped frame 32.

As shown in FIG. 5, the opposite (i.e., the back) side 76 of multi-diameter core adapter 38 is substantially hat-shaped for supporting preferably a print media core with a ⅜ inch inner core diameter. Hat-shaped side 76 has an outwardly projecting (away from ring-shaped frame 32) hollow (on the inside) crown portion 78 (FIGS. 4, 5) intended for insertion into a ⅜ inch inner diameter print media core and a substantially flat brim portion 80 which is essentially the underside of base 53 (FIG. 6), i.e., brim portion 80 includes the necessary cutouts for receptacles 58, 60 on each side as illustrated in FIG. 5. In accordance with the best mode for practicing the present invention, crown portion 78 is designed to fit snugly inside a ⅜ inch inner diameter print media core to a certain extent (e.g., about a third to a half of the outer surface area of crown portion 80) to support a mounted (in between roll holders 26, 28) print media roll with a ⅜ inch inner core diameter (not shown).

Core adapter 48 has a bowl-shaped side 68 with a pair of opposing snap receptacles 72, 74 (FIG. 4) which is essentially identical in shape and function to side 52 of core adapter 38. Ring-shaped frame 42 is provided with a plastic snap 70 molded on the inside of frame 42 (FIG. 4) which is essentially identical in shape and function to snap 62 of FIG. 7. The opposite side of core adapter 48, i.e. side 77 shown in FIGS. 1–3, is essentially identical in shape and function to side 76 of core adapter 38.

Print media roll holders 26, 28 are preferably made of plastic. Other materials and/or material combinations may be used to manufacture roll holders 26, 28, provided such other materials and/or material combinations fall within the scope of the present invention.

The multi-diameter core adapter of the present invention is preferably pivotally mounted on each side inside the ring-shaped frame for rotation in both directions (clockwise and counterclockwise) on two opposing side pins or axles inserted laterally through the ring-shaped frame and the semicircular side walls of the core adapter as generally depicted in FIG. 4.

Figure 9:
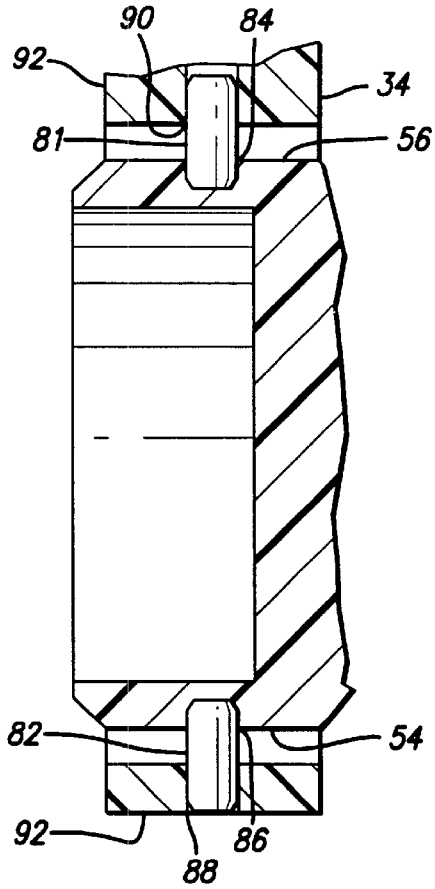
FIG. 9 is a cross-sectional view taken along section line 9—9 of FIG. 8 in accordance with the present invention.

Specifically, a substantially solid cylindrical steel or plastic pin 82 (FIGS. 4, 9) secures laterally semicircular outer wall 54 of core adapter 38 to ring-shaped frame 32 through a generally circular aperture 86 on semicircular outer wall 54 of core adapter 38 (FIG. 6) and through a generally circular aperture 88 on tubular wall 92 of ring-shaped frame 32 (FIGS. 4, 7), respectively (FIG. 9). The outer end of pin 82 is preferably mounted flush with outer wall 92 as shown in FIG. 9. On the opposite side, another identically shaped steel or plastic pin 81 (FIG. 7) secures laterally semicircular outer wall 56 of core adapter 38 to ring-shaped frame 32 through an identically shaped aperture 84 (FIG. 5) on semicircular outer wall 56 of core adapter 38 and through an identically shaped aperture 90 (FIG. 7) on the inside of tubular wall 92 of ring-shaped frame 32, respectively, as illustrated in FIG. 9. A pivot axis 40 for rotation of core adapter 38 in both directions (clockwise and counterclockwise) can thus be defined through a longitudinal axis 41 of pin 82 (FIG. 4) and through a longitudinal axis 73 of opposing pin 81. Pin 81 is preferably installed first as it mounts on the inside of frame 32 with pin 82 mounted thereafter (FIGS. 4, 7). A person skilled in the art would readily appreciate that other means of pivoting core adapter 38 for rotation within frame 32 in both directions (clockwise and counterclockwise) may be utilized, provided such other pivoting means fall within the scope of the present invention.

In a similar fashion, as generally depicted in FIG. 4, a substantially solid cylindrical steel or plastic pin 94 secures laterally semicircular outer wall 96 of core adapter 48 to ring-shaped frame 42 through a generally circular aperture (not shown) on semicircular outer wall 96 of core adapter 48 and through a generally circular aperture 98 on tubular wall 100 of ring-shaped frame 42, respectively. On the opposite side, another identically shaped pin (not shown) secures semicircular outer wall 97 of core adapter 48 to ring-shaped frame 42 through an identically shaped aperture (not shown) on semicircular outer wall 97 of core adapter 48 and through an identically shaped aperture (not shown) on the inside of tubular wall 100 of frame 42, respectively. A pivot axis 50 (FIG. 4) for rotation of core adapter 48 in both directions (clockwise and counterclockwise) can thus be defined through a longitudinal axis 81 of pin 94 and through a corresponding longitudinal axis of its opposing pin (not shown). A person skilled in the art would readily appreciate that other means of pivoting core adapter 48 for rotation within frame 42 in both directions (clockwise and counterclockwise) may be utilized, provided such other pivoting means fall within the scope of the present invention.

Figure 8:
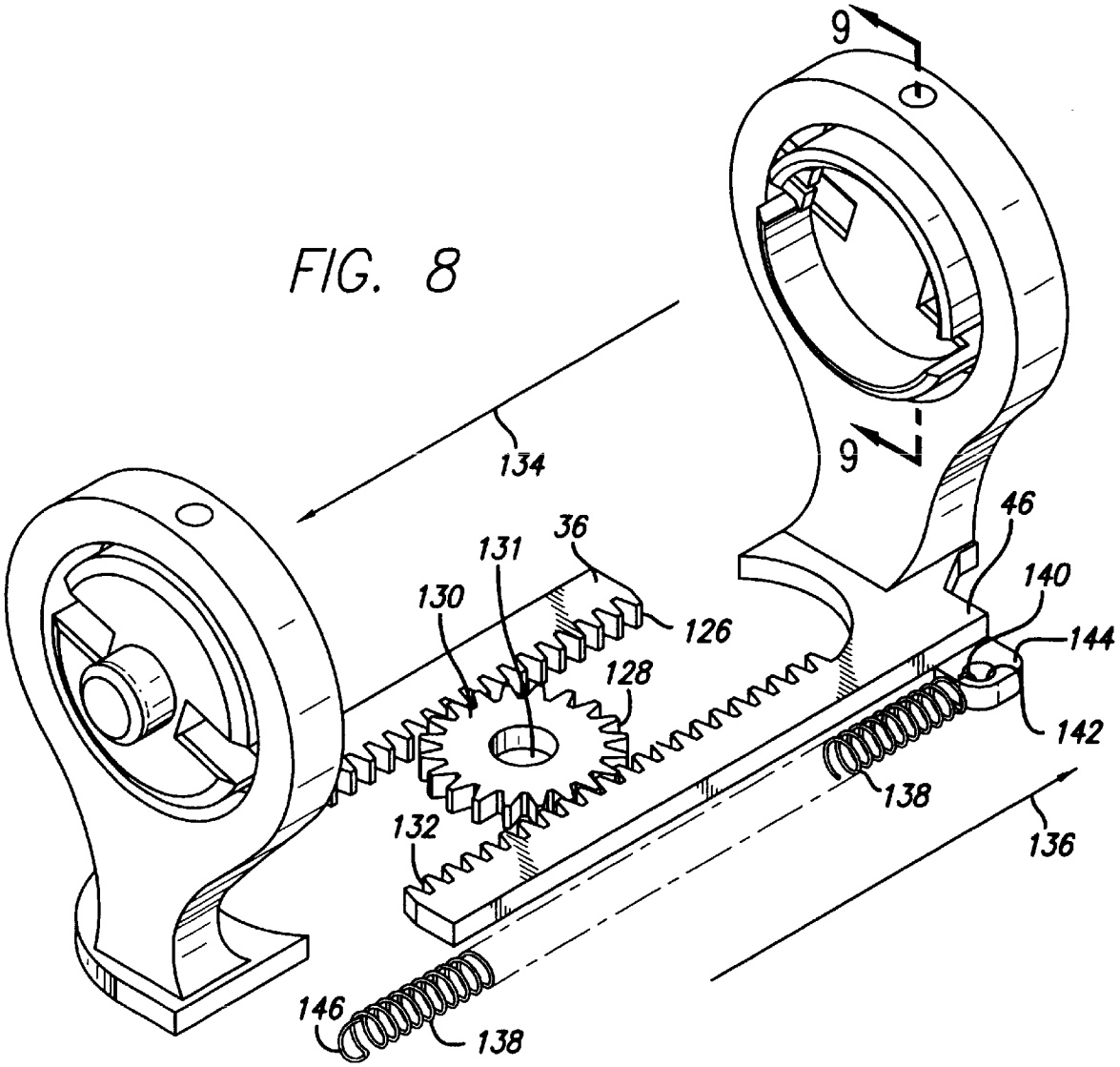
FIG. 8 is a perspective view of the print media roll holders of FIG. 1 with a rack and pinion gear mechanism in accordance with the present invention.

In accordance with another preferred embodiment of the present invention and as generally illustrated in FIG. 8, elongated guide rack 36 includes on one side a series of teeth 126 which mesh with a corresponding set of teeth 128 circumferentially formed on a pinion gear 130 which is preferably mounted for rotation on a spindle (not shown) secured (not shown) at one end to printer base 22. Similarly, elongated guide rack 46 includes on one side a series of teeth 132 which mesh, respectively, with pinion gear teeth 128 at a location essentially diametrically displaced from guide rack 36.

Guide racks 36 and 46 are mounted (not shown) on printer base 22 and slide in substantially parallel tracks (not shown) in printer base 32. The mounted guide racks 36, 46 move back and forth in their respective tracks (reciprocal linear movement) relative to a center 131 (FIG. 8) of pinion gear 130. For example, when guide rack 36 is moved by the user to the left as shown by a directional arrow 134 (FIG. 8) pinion gear 130 turns in a counter-clockwise direction (not shown) which in turn causes rack 46 to move to the right as shown by a directional arrow 136 (FIG. 8) thereby positioning print media roll holders 26, 28 at a desired spacing to enable mounting of print media roll 30 (FIG. 2).

Guide racks 36, 46 may be made of a polycarbonate/ABS (acrylonitrile-butadiene-styrene) alloy. Pinion 130 may be made of nylon material mixed with suitable additives. A person skilled in the art would recognize that other materials, e.g., acetal, and/or combinations of materials may be utilized to make the rack-and-pinion mechanism used in the present invention, as long as such other materials and/or combinations of materials agree with the intended purpose of the present invention.

Figure 10:
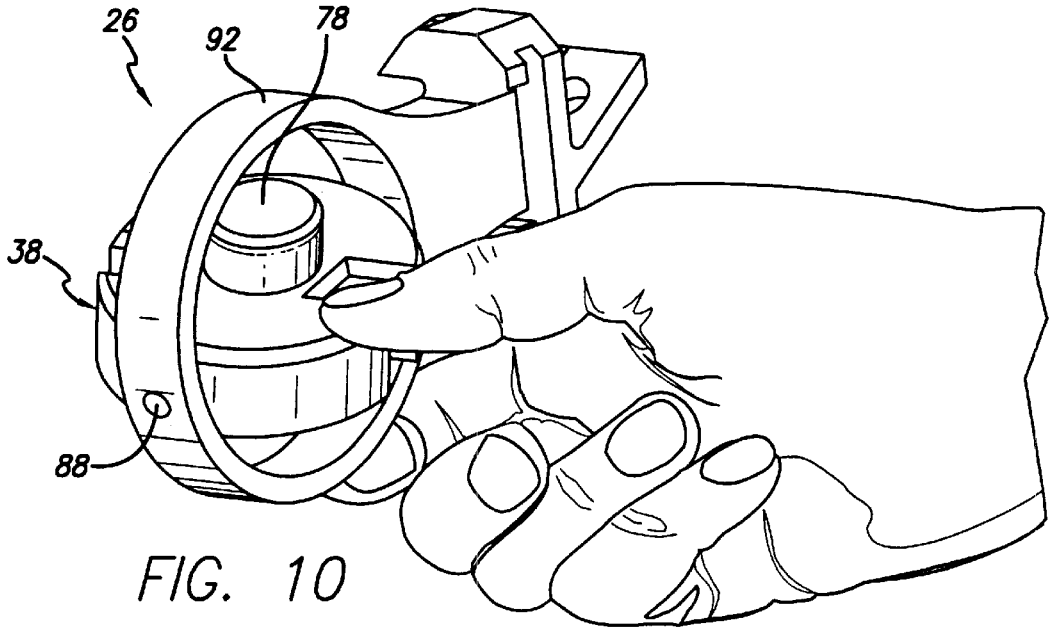
FIG. 10 is a perspective view of a preferred embodiment of the present invention.

A steel coil spring 138 is provided to bias guide rack 46 as depicted in FIG. 8. More particularly, end 140 of coil spring 138 is preferably looped through an aperture 142 provided in a tab 144 of guide rack 46 with the tab extending substantially away from the body of rack 46 as illustrated in FIG. 8. The other end 146 of coil spring 138 is preferably looped through an aperture (not shown) provided on the inside of printer base 22 to bias guide rack 46 with a tendency to reduce the spacing between roll holders 26 and 28, i.e. a mounted roll such as roll 30 (FIG. 2) would be held securely by roll holders 26, 28 under tension from spring 138. Before a user can mount a print media roll of a specific inner core diameter on core adapters 38, 48, the core adapters must be appropriately turned on the particular side adapted to accommodate the selected inner core diameter which may be done manually by the user as generally shown in FIG. 10.

Adjusting the print media roll holder of the present invention for mounting a certain size inner core diameter by the user is straightforward. As illustrated in FIG. 1, the first step involves the user opening printer lid 24 to provide access to print media roll holders 26, 28. Assuming the core adapter on each roll holder has previously been set for holding a print media roll of ⅜ inch inner diameter core, the next step involves manually turning each core adapter 180 degrees about its pivot axis in either direction (clockwise or counter-clockwise) from its initial (⅜ inch inner diameter core facing) position (FIG. 10) to allow the bowl-shaped side of each core adapter to face each side of print media roll 30 which has a 1 inch inner core diameter 31 (FIG. 2). The roll holder with multi-diameter core adapter of the present invention resembles to a certain extent a two-sided mirror pivoted for rotation on a central axle. The next step is mounting the 1 inch inner core diameter print media roll 30 on roll holders 26, 28 as shown in FIGS. 2–3 and then closing printer lid 24 for printer operation (not shown).

A person skilled in the art would readily appreciate that the inventive roll holder and multi-diameter core adapter combination may easily be adapted for use with different inner core diameter sizes as long as such adaptations do not deviate from the intended purpose of the present invention.

The novel print media roll holder and multi-diameter core adapter combination does not need removable parts to operate, occupies a relatively small space inside the printer compared to conventional roll holders with cylindrical stepped core adapters and is designed for easy adapter core size adjustment by the user.

It should also be appreciated by a person skilled in the art that other components and/or configurations may be utilized in the above-described embodiments, provided that such components and/or configurations do not depart from the intended purpose and scope of the present invention.

While the present invention has been described in detail with regards to the preferred embodiments, it should be appreciated that various modifications and variations may be made in the present invention without departing from the scope or spirit of the invention. In this regard it is important to note that practicing the invention is not limited to the applications described hereinabove. Many other applications and/or alterations may be utilized provided that they do not depart from the intended purpose of the present invention.

It should be appreciated by a person skilled in the art that features illustrated or described as part of one embodiment can be used in another embodiment to provide yet another embodiment such that the features are not limited to the specific embodiments described above. Thus, it is intended that the present invention cover such modifications, embodiments and variations as long as they come within the scope of the appended claims and their equivalents.

What is claimed is:

1. A print media roll holder adapted for use with print media rolls of different core sizes, comprising:

a frame; and a core adapter pivotally coupled within said frame for rotational movement about a central axis, said core adapter having a first side adapted for coupling to a print media core of a first inner core diameter and a second side adapted for coupling to a print media core of a second inner core diameter.

2. The print media roll holder of claim 1, wherein said first side of said core adapter is adapted for coupling to a print media core of a 1 inch inner core diameter.

3. The print media roll holder of claim 1, wherein said second side of said core adapter is adapted for coupling to a print media core of a ⅜ inch inner core diameter.

4. The print media roll holder of claim 1, wherein said first side of said core adapter is adapted for coupling to a print media core of a ⅜ inch inner core diameter.

5. The print media roll holder of claim 1, wherein said second side of said core adapter is adapted for coupling to a print media core of a 1 inch inner core diameter.

6. The print media roll holder of claim 1, wherein said frame is substantially ring-shaped and includes a base portion supported by a guide rack adapted for positional adjustment of said print media roll holder within an image forming device.

7. An apparatus for mounting print media rolls of different core sizes, said apparatus comprising:

a first print media roll holder having a frame;

a second print media roll holder having a frame and disposed opposite said first print media roll holder for accommodating print media rolls of different core sizes between said first and second print media roll holders, each of said first and second print media roll holders including a core adapter pivotally coupled within a respective frame for rotational movement about a central axis, each said core adapter having a first side adapted for coupling to a print media core of a first inner core diameter and a second side adapted for coupling to a print media core of a second inner core diameter; and means for adjusting the position of said first and second print media roll holders in a reciprocal linear fashion.

8. The apparatus of claim 7, wherein each frame is substantially ring-shaped and includes a base portion to support said frame.

9. The apparatus of claim 8, wherein said adjusting means includes first and second guide racks respectively coupled to the base portion of said ring-shaped frames, each of said first and second guide racks adapted to movably engage a pinion gear mounted between said first and second guide racks for rotation, said pinion gear rotation causing said first and second guide racks to move in a reciprocal linear fashion relative to said pinion gear to adjust the position of said first and second print media roll holders.

10. A method for mounting print media rolls of different core sizes on a pair of oppositely displaced roll holder frames with each frame having a core adapter pivotally connected to the frame and adapted for rotation about a central frame axis within the frame, the method comprising the steps of:

(a) rotating the core adapters about their respective central axes to select a frame side adapted for coupling to a desired core size of a print media roll; and (b) coupling each selected frame side to a respective end of the print media core to support the print media roll thereon.

11. The method of claim 10, further comprising the step of adjusting the relative position of the roll holder frames to provide enough space to mount the print media core before step (b).

* * * * *

UNITED STATES PATENT AND TRADEMARK OFFICE

CERTIFICATE OF CORRECTION

PATENT NO. : 6,503,008 B2 
DATED : January 7, 2003
INVENTOR(S) : Thomas Michael Zevin et al.

It is certified that error appears in the above-identified patent and that said Letters Patent is hereby corrected as shown below:

Title page,
Item [73], Assingee, should read as follows:
-- [73] Assingee: ZIH Corp., a Delaware Corporation with it's principal office in Hamilton, Bermuda. --

Signed and Sealed this

First Day of June, 2004

JON W. DUDAS
*Acting Director of the United States Patent and Trademark Office*